US012303757B1

(12) United States Patent
Ho

(10) Patent No.: US 12,303,757 B1
(45) Date of Patent: May 20, 2025

(54) SUPER BRIGHT FLYING RING

(71) Applicants: TOPIO LLC., Dover, DE (US); Hoang Vinh Ho, Hanoi (VN)

(72) Inventor: Hoang Vinh Ho, Hanoi (VN)

(73) Assignees: TOPIO LLC, Dover, DE (US); Hoang Vinh Ho, Hanoi (VN)

( * ) Notice: Subject to any disclaimer, the term of this patent is extended or adjusted under 35 U.S.C. 154(b) by 0 days.

(21) Appl. No.: 18/512,847

(22) Filed: Nov. 17, 2023

(51) Int. Cl.
*A63B 67/06* (2006.01)
*A63H 33/18* (2006.01)

(52) U.S. Cl.
CPC ..... *A63B 67/06* (2013.01); *A63H 33/18* (2013.01); *A63B 2225/74* (2020.08)

(58) Field of Classification Search
CPC .. A63H 33/18; A63B 67/06; A63B 2067/063; A63B 2225/74
USPC ..... 446/46, 47, 48
See application file for complete search history.

(56) References Cited

U.S. PATENT DOCUMENTS 2,744,976 A * 5/1956 Black ..... H01H 35/14 200/80 R
3,786,246 A 1/1974 Johnson et al.
3,798,834 A * 3/1974 Samuel ..... A63H 33/18 362/802
3,812,614 A 5/1974 Harrington
4,080,753 A 3/1978 Hiner
4,104,822 A * 8/1978 Rodgers ..... A63H 33/18 473/589
4,135,324 A 1/1979 Miller et al.
4,297,809 A 11/1981 Branson
4,301,616 A 11/1981 Gudgel
4,431,196 A * 2/1984 Kutnyak ..... A63H 33/18 473/588
4,435,917 A * 3/1984 Lee ..... A63H 33/18 446/47
D274,142 S 6/1984 Mcnab
(Continued)

FOREIGN PATENT DOCUMENTS

CN 2274511 Y * 2/1998
CN 2460151 Y 11/2001
(Continued)

OTHER PUBLICATIONS

English machine translation of CN2274511Y (Yang) (Year: 1998).*
(Continued)

*Primary Examiner* — Joseph B Baldori
(74) *Attorney, Agent, or Firm* — Morrison & Foerster LLP

(57) ABSTRACT

Disclosed herein is a flying ring and operations thereof. The flying ring may comprise LED strip(s) mounted around a rim, and a controller that automatic controls operation of the LED strip. The LED strip may be controlled using a centrifugal switch based on the flying disc having been thrown, rotating, and/or flying in the air. Players can adjust the color, light intensity, and/or display mode of the LED strip to increase the appeal when playing. The flying ring can be suitable both for use as an entertainment toy and for use in sports. The flying ring may have good impact resistance, good water resistance, floats on water, is easy to hold, and is safe for players. The LED strip(s) can include a plurality of LEDs including, but not limited to, three LEDs for, e.g., attractive flying lighting effects, to 3000 LEDs or more for, e.g., super high brightness.

20 Claims, 12 Drawing Sheets

(56) References Cited

U.S. PATENT DOCUMENTS

| | | | | | |
|---|---|---|---|---|---|
| 4,563,160 | A * | 1/1986 | Lee | A63H 33/18 | 446/485 |
| 4,669,995 | A * | 6/1987 | Lombard | A63H 33/18 | 446/48 |
| D295,970 | S | 5/1988 | Mcnab | | |
| 4,778,428 | A * | 10/1988 | Wield | A63H 33/18 | 446/485 |
| 4,944,707 | A * | 7/1990 | Silverglate | A63H 33/18 | 446/48 |
| D312,103 | S | 11/1990 | Lenox | | |
| 5,032,098 | A * | 7/1991 | Balogh | A63H 33/18 | 473/588 |
| 5,319,531 | A * | 6/1994 | Kutnyak | A63H 33/18 | 473/588 |
| D354,525 | S | 1/1995 | Sullivan | | |
| 5,611,720 | A * | 3/1997 | Vandermaas | A63B 65/10 | 446/485 |
| 5,630,742 | A * | 5/1997 | Honaker | A63H 33/18 | 473/588 |
| D386,221 | S | 11/1997 | Ybanez | | |
| D386,223 | S | 11/1997 | Imai | | |
| D390,282 | S | 2/1998 | Burdick | | |
| 5,720,651 | A * | 2/1998 | Chien | A63H 33/18 | 415/115 |
| 5,800,237 | A * | 9/1998 | Cummings | A63H 33/18 | 473/589 |
| 6,113,453 | A * | 9/2000 | Stuffelbeam | A63H 33/18 | 446/236 |
| 6,175,196 | B1 * | 1/2001 | Ragner | H05B 47/11 | 315/156 |
| 6,247,989 | B1 * | 6/2001 | Neff | A63H 33/18 | 473/588 |
| 6,547,623 | B1 * | 4/2003 | Collado | A63H 33/18 | 473/570 |
| 6,682,384 | B2 * | 1/2004 | Wang | A63H 33/18 | 446/46 |
| 6,726,521 | B2 | 4/2004 | Peterson | | |
| 6,764,371 | B2 | 7/2004 | Hartman et al. | | |
| 6,783,421 | B1 * | 8/2004 | Lopez | A63H 23/10 | 446/485 |
| 6,857,770 | B2 * | 2/2005 | Moore | A63H 33/22 | 362/555 |
| D503,953 | S | 4/2005 | Holgate | | |
| 7,037,169 | B2 * | 5/2006 | Benedek | A63H 1/24 | 446/259 |
| 7,270,588 | B2 | 9/2007 | Frazier | | |
| 7,347,758 | B2 | 3/2008 | Moore | | |
| 7,766,718 | B2 * | 8/2010 | Rago | A63H 1/24 | 446/485 |
| D626,057 | S | 10/2010 | Calvin | | |
| 8,142,295 | B2 * | 3/2012 | Mesika | A63H 33/22 | 472/68 |
| 8,157,607 | B2 * | 4/2012 | Cowles | A63H 33/22 | 446/48 |
| D659,812 | S | 5/2012 | Shek | | |
| D683,516 | S | 6/2013 | Elias | | |
| 8,608,598 | B2 * | 12/2013 | Hoang | A63H 33/18 | 473/590 |
| 8,858,289 | B2 * | 10/2014 | Forte | A63H 33/18 | 446/242 |
| 9,320,981 | B2 * | 4/2016 | Dawson | A63H 33/18 | |
| 9,550,566 | B2 | 1/2017 | Henning, Jr. | | |
| D778,370 | S | 2/2017 | Moore | | |
| D859,536 | S | 9/2019 | Cope | | |
| D860,332 | S | 9/2019 | Cope | | |
| 11,037,322 | B2 | 6/2021 | Hildreth | | |
| 11,161,053 | B2 | 11/2021 | Phipps | | |
| 11,612,828 | B2 | 3/2023 | Kocking | | |
| 11,786,801 | B2 * | 10/2023 | Gayton | A63C 11/003 | 362/109 |
| 2003/0162470 | A1 | 8/2003 | Peterson | | |
| 2003/0186615 | A1 | 10/2003 | Wang | | |
| 2004/0043694 | A1 | 3/2004 | Cohen | | |
| 2004/0220001 | A1 * | 11/2004 | Oister | A63B 37/0024 | 473/588 |
| 2007/0212973 | A1 * | 9/2007 | Brockes | A63H 33/18 | 446/47 |
| 2009/0004945 | A1 | 1/2009 | Delassus | | |
| 2011/0053716 | A1 | 3/2011 | Lewis | | |
| 2011/0074109 | A1 | 3/2011 | Werth | | |
| 2016/0136517 | A1 * | 5/2016 | Putland | A63H 33/18 | 273/449 |
| 2018/0181654 | A1 * | 6/2018 | Young | A63B 43/06 | |
| 2019/0383450 | A1 | 12/2019 | Meir | | |
| 2022/0314137 | A1 * | 10/2022 | Liao | A63B 65/00 | |
| 2022/0410026 | A1 * | 12/2022 | Sacha | A63H 33/009 | |
| 2023/0037021 | A1 | 2/2023 | Hoang | | |
| 2024/0075400 | A1 | 3/2024 | Hoang | | |
| 2024/0246004 | A1 * | 7/2024 | Hofstede | A63B 65/10 | |
| 2024/0252947 | A1 * | 8/2024 | Lin | F21V 23/001 | |

FOREIGN PATENT DOCUMENTS

| | | | | |
|---|---|---|---|---|
| CN | 200957298 | Y | 10/2007 | |
| CN | 201969354 | U | 9/2011 | |
| CN | 302620087 | S | 10/2013 | |
| CN | 302695825 | | 12/2013 | |
| CN | 306714415 | S | 7/2021 | |
| CN | 308198909 | S | 8/2023 | |
| DE | 8617420 | U1 | 12/1986 | |
| DE | 19649794 | C2 | 8/1999 | |
| DE | 102005045494 | A1 | 5/2006 | |
| FR | 3121846 | A3 * | 10/2022 | |
| JP | 2016-221202 | A | 12/2016 | |
| KR | 20-0244774 | Y1 | 10/2001 | |
| RU | 2794976 | C1 * | 4/2023 | |
| WO | WO-9924134 | A1 * | 5/1999 | A63H 33/18 |
| WO | 2009/049329 | A1 | 4/2009 | |

OTHER PUBLICATIONS

English machine translation of RU2794976C1 (Zhuravlev) (Year: 2023).*

English machine translation of FR3121846A3 (Beltran) (Year: 2022).*

Fishpond.com. Flying Ring Frisbee. Retrieved from: https://www.fishpond.com/Toys/3x-Flying-Ring-Frisbee, 9 pages.

Ho, Office Action dated Feb. 15, 2024, directed to U.S. Appl. No. 18/307,667; 7 pages.

Ho, Office Action dated Mar. 21, 2024, directed to U.S. Appl. No. 29/917,714; 9 pages.

International Search Report and Written Opinion mailed Mar. 8, 2024, directed to International Application No. PCT/US2023/080309; 13 pages.

Tosy Flying Ring. By Tosy Story. Dated Nov. 30, 2023. Found online [Mar. 14, 2024]. https://www.amazon.com/TOSY-Flying-Ring-Waterproof-Lightweight/dp/BOCMPBCDFM?th=1 (Year: 2023); 3 pages.

Ho, Office Action dated Jul. 1, 2024, directed to U.S. Appl. No. 17/874,047; 8 pages.

Ho, Office Action dated Jun. 27, 2024, directed to U.S. Appl. No. 29/917,714; 7 pages.

Ho, Office Action dated Jun. 3, 2024, directed to U.S. Appl. No. 18/307,667; 8 pages.

Ho, Office Action dated May 23, 2024, directed to U.S. Appl. No. 18/307,667; 9 pages.

Declaration of Hoang Vinh Ho dated Dec. 11, 2024, directed to U.S. Appl. No. 18/512,847, filed Nov. 17, 2023, and U.S. Appl. No. 18/512,847, filed Nov. 17, 2023, with Exhibits A, B, and C; 8 pages.

* cited by examiner

SUPER BRIGHT FLYING RING

FIELD

The present invention relates to a flying ring (for ultimate frisbee, disc golf, etc.) equipped with one or more light emitting diode (LED) strips mounted around the rim of the flying ring.

BACKGROUND

As is known, the flying ring is an aerodynamic object that is basically in the shape of a circle with a hole in the middle, allowing a player to hold it at one or more surfaces (e.g., edges), such as the inner and/or outer rims of the flying ring. The player may use wrist and arm movements to throw the flying ring into the air. A combination of a player's spin and good throw can send the flying ring far in the air and/or cause it to fly fast through the air.

Flying rings may be used for a variety of purposes ranging from recreational use (e.g., toys) to professional sports use. However, the flying rings are not equipped with lights (e.g., LED lights) needed to make them suitable for use in low-lighting conditions (cloudy or rainy weather, indoors, etc.). For example, the flying rings may have limited use; not being suitable for both use as a toy for entertainment, and at the same time, use in a professional team sport, particularly when used in competitive matches in different weather conditions such as dark, rainy weather.

It is estimated that at least a few million people participate in professional team sports using a frisbee, at various scales from teams playing in schools, clubs, to professional teams (professional or national teams that compete against each other on an international scale). With widespread popularity, it can lead to matches in a variety of settings, for example, playing in the dark or in weather that lacks natural light, playing in or near the stadiums, playing in an area with water like a beach, etc. An improved flying ring suitable for a variety of uses is desired.

BRIEF SUMMARY

Disclosed herein is a flying ring, which reduces or overcomes one or more of the above-mentioned problems. The flying ring may be suitable for use both as a toy for amusement, and at the same time, in professional team sports. The flying ring can automatically light up when flying. In some examples, the flying ring may automatically turn off (e.g., when not flying, when stopped) to save battery life. The battery may be a rechargeable battery, increasing the convenience and time of use. The flying ring may be configured to emit different and/or a plurality of colors, including emitting light using different LEDs. For example, the flying ring may be configured to randomly change the colors of the light emitted by the LEDs to create more excitement when playing with it. Additionally or alternatively, the flying ring may glow in the dark even when the LEDs are not emitting light. The flying ring may have good impact resistance, water resistance, and buoyancy, allowing a player to play comfortably in different environments (e.g., near or in water, dust, sand, hard surfaces, etc.). For example, the flying ring may float in water. Examples of the disclosure include a flying ring having an average density (or gravity) less than the average density (or gravity) of water so that it can float on the water. The flying ring may be safe for all types of players, including children. It may be easy to hold, throw, and/or catch.

It should be understood that the invention is not limited to the purposes mentioned herein, but may also include other purposes, including those which can be recognized by the average person.

In some aspects, the body of the flying ring comprises a circular (outer) rim with a hole in the middle (inner rim surrounding the hole). In some aspects, the hole may not comprise any material. In other aspects, the hole may comprise a material different than the material of the body of the flying ring. When thrown, the body of the flying ring may create a pressure difference between the air streams flowing above and below the flying ring. This pressure difference may create a force that lifts the flying rim, allowing it to fly over long distances. In some aspects, the flying ring may comprise at least one LED strip arranged on the outer rim, inner rim, or both, of the flying ring. For example, the flying ring may comprise at least one LED strip arranged on the outer rim that emits light outward in a radial direction from the center of rotation of the flying ring.

The flying ring may also comprise an LED strip guard that covers and protects the outside of the LED strip. The LED strip guard may be attached to the body of the flying ring. In some aspects, the LED strip guard comprises a material that is at least partially transparent so that light emitted from the LED strip can be transmitted outwards (e.g., radially). The LED strip guard may comprise a soft, elastic, impact-resistant material, creating an easy-to-grip and safe feeling for the player. In some examples, the inner rim of the flying ring comprises a soft and elastic plastic rim for a comfortable and safe grip of the flying ring while playing.

The flying ring may comprise one or more compartments. In some examples, the compartment(s) may be visible from a bottom view of the flying ring. The storage compartments may be configured to contain at least a battery and a controller. Example types of battery may include, but are not limited to, a button cell or a rechargeable battery. The flying ring may include a battery charging port with a watertight cover (e.g., if using a rechargeable battery), and/or a cover with a watertight gasket (e.g., if using a button cell battery), protecting the battery from water.

The controller may comprise an input that allows it to receive power from the battery. The controller may also comprise an output coupled to the LED strip. The LED strip(s) may be configured as both an energy source to light up one or more LED lights and as an electrical coupler that electrically couples the battery to the controller. The LED lights may be arranged evenly around a rim of the flying ring.

The flying ring comprises one or more buttons, switches, and/or knobs. For example, the flying ring may comprise a button configured such to receive an input from a player. The player may can select or change the color, the brightness (increase or decrease the intensity), or the display mode of the LED strip (to enhance entertainment).

As another example, the flying ring may include at least one centrifugal switch that allows automatically turning on the LED lights by creating a closed electrical circuit. Creating the closed circuit creates an electrical coupling between the battery and the LED lights, powering the LEDs when the ring rotates or flies. In some examples, the centrifugal switch may also automatically turn off the power source (including creating an open circuit) when the flying ring is not rotating or flying to save battery life. The centrifugal switch can comprise an accelerometer, gyroscope, metal balls, circuit contacts, or a combination thereof. In instances where the centrifugal switch includes a metal ball, the metal ball may be attracted to move toward a nearby magnet. Under the effect of centrifugal force, the ball moves away from the magnet and comes into contact with two electrodes, where closing the circuit allows current to pass through those two electrodes. In some aspects, the flying ring may include at least two centrifugal switches arranged symmetrically about the center of rotation of the flying disc. When the flying disc is rotated, the two centrifugal switches may simultaneously close the circuit, causing the controller to automatically power the LED lights so that they can emit light.

In another aspect, the flying ring is made so that the density is less than that of water so that it can float on the water surface.

DETAILED DESCRIPTION

Figure 1:
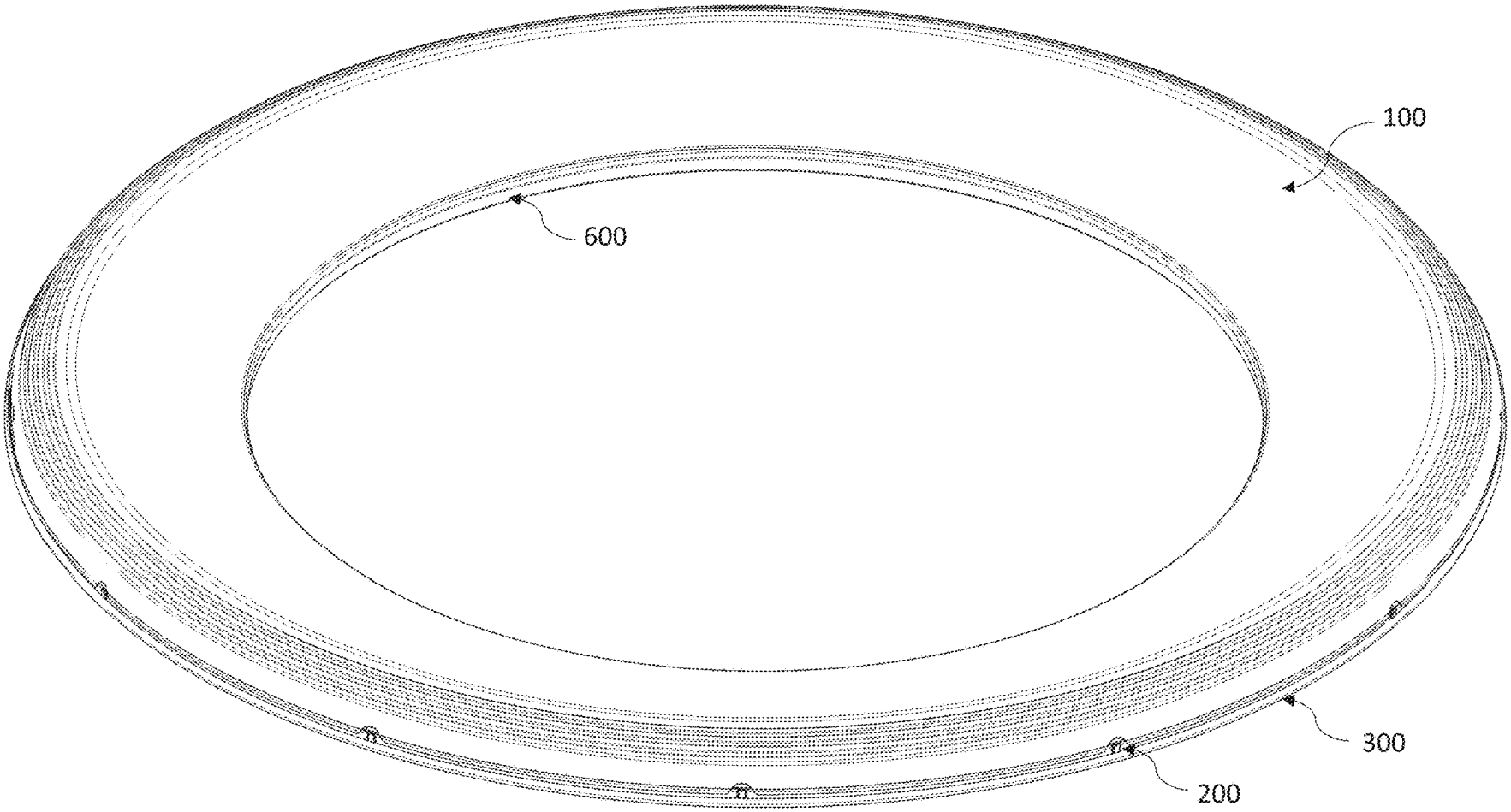
FIG. 1 illustrates a perspective, top view of an example flying ring, according to examples of the disclosure.
Figure 2:
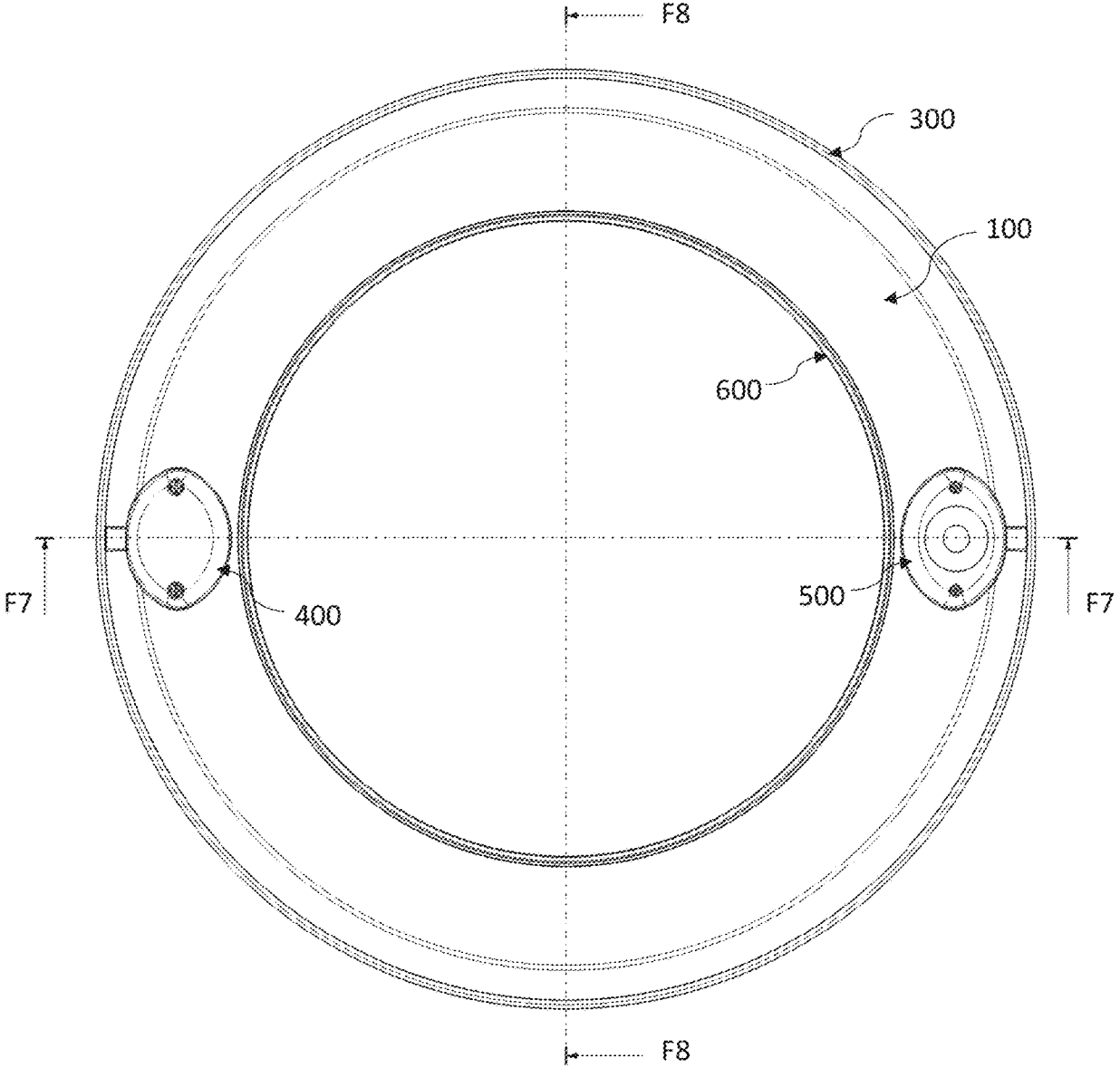
FIG. 2 illustrates a bottom view of an example flying ring, according to examples of the disclosure.
Figure 3:
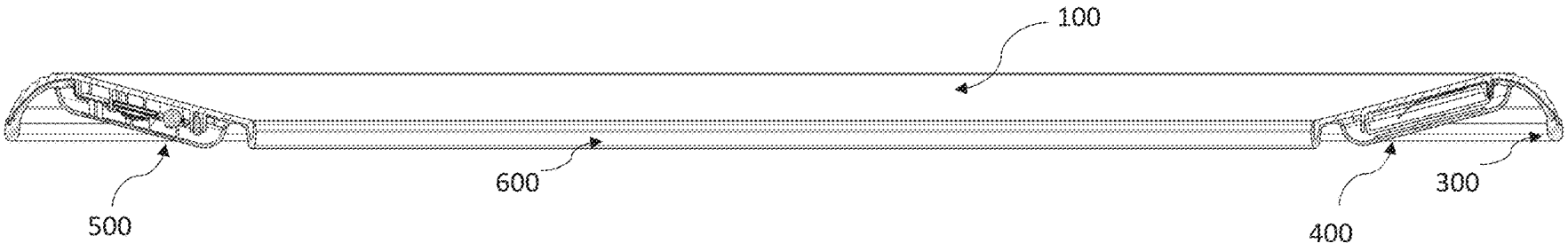
FIG. 3 illustrates a cross-sectional view of an example flying ring, according to examples of the disclosure.
Figure 4:
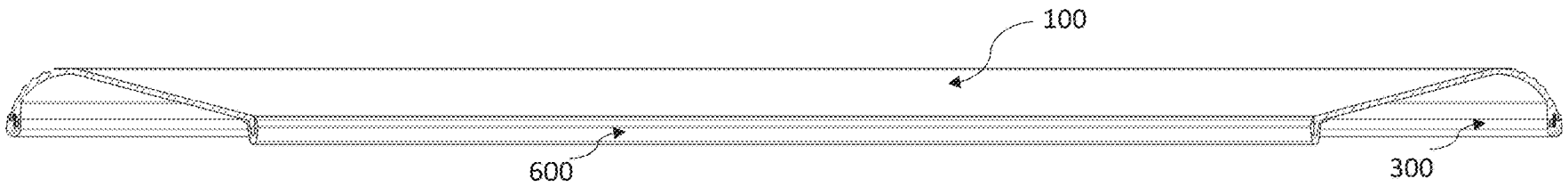
FIG. 4 illustrates a cross-sectional view of an example flying ring, according to examples of the disclosure.
Figure 5:
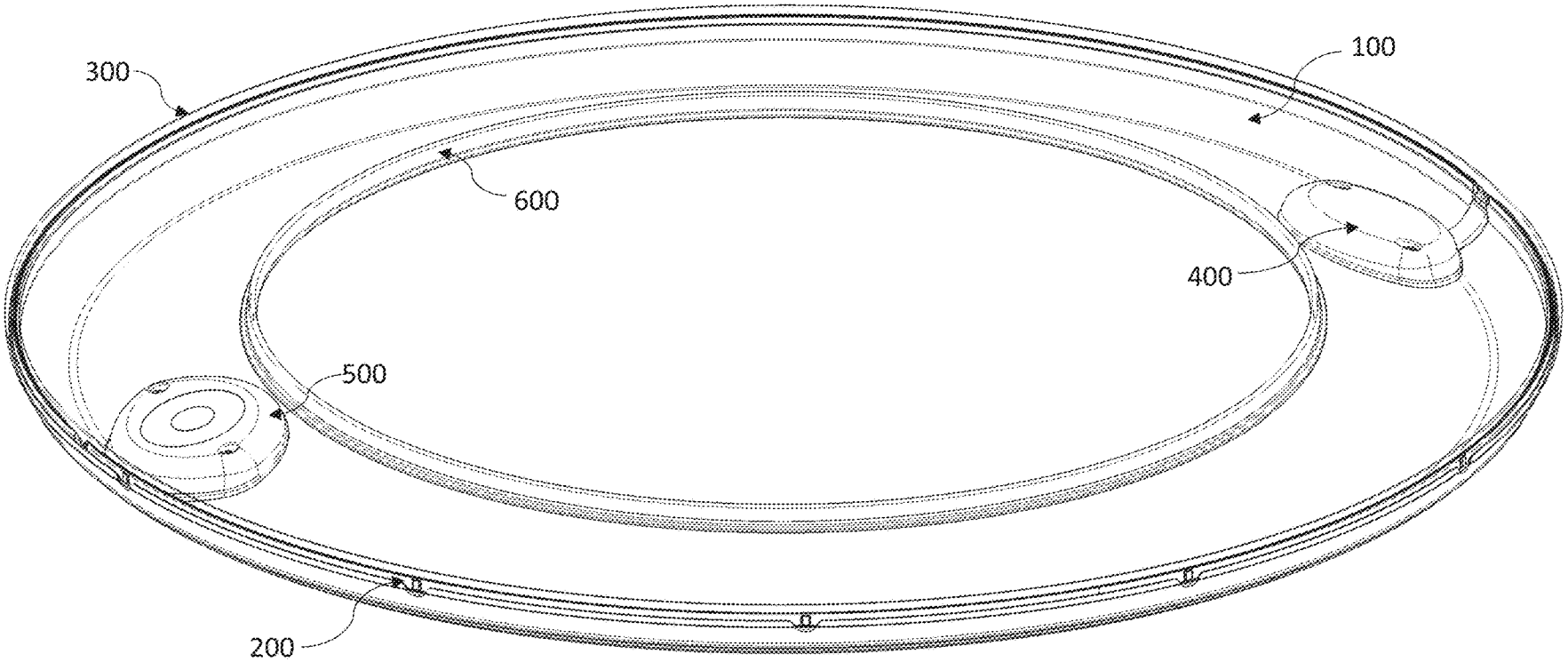
FIG. 5 illustrates a perspective, bottom view of an example flying ring, according to examples of the disclosure.
Figure 6:
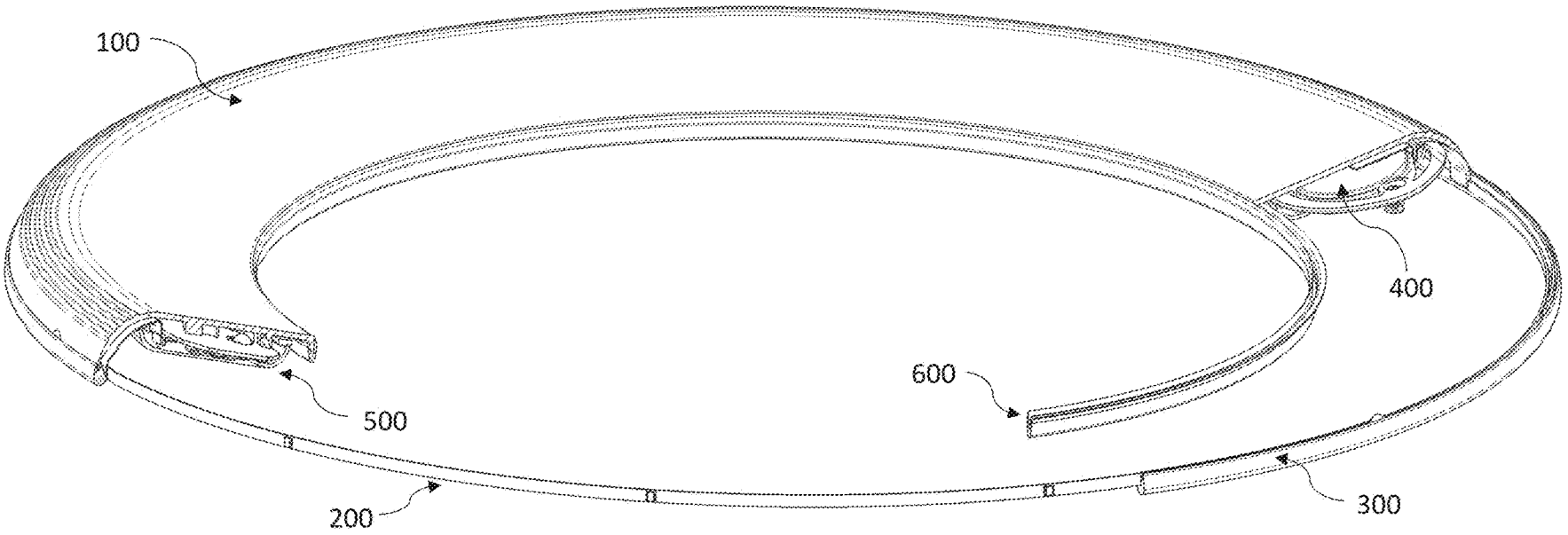
FIG. 6 illustrates a partially cropped perspective, top view of an example flying ring, according to examples of the disclosure.

Described herein is a flying ring configured to emit light. The flying ring can be used as an entertainment toy or a sports device. The flying ring may comprise one or more LED lights located on an outside rim (e.g., perimeter) of the flying ring. The LED lights on the flying ring can display monochrome or multiple colors. The flying ring may comprise one or more LED strips. The LED strip may comprise multiple LEDs formed on a flexible printed circuit board (FPCB). The LED lights can be installed into the flying ring using a molding process and technology for high impact resistance.

In some examples, the flying ring may include a centrifugal switch that controls the on/off state of the LED lights. The LED lights can be automatically switched to the on state (emit light) when the flying ring is thrown, flies through the air, or both. The LED lights can be automatically turned off when not in use (off state) to save battery life. The flying ring can use rechargeable batteries or disposable batteries for providing power to the LED lights and/or one or more circuits.

The flying ring may include one or more buttons, switches, and/or knobs. One example type of knob can be a knob that can be configured to receive an input for adjusting color and/or brightness of the light emitted by the LED lights. Additionally or alternatively, the knob may allow the user to select an LED display mode. One non-limiting example LED display mode includes changing colors or flashing the lights when flying. In some examples, the flying ring may be capable of floating on water. Alternatively or alternatively, the flying ring may be waterproof. This can allow players to comfortably play with the flying ring in water, dust, sand, or other types of environments.

The following description is presented to enable a person of ordinary skill in the art to make and use various examples. Descriptions of specific devices, techniques, and applications are provided only as examples. These examples are being provided solely to add context and aid in the understanding of the described examples. It will thus be apparent to a person of ordinary skill in the art that the described examples may be practiced without some or all of the specific details. Other applications are possible, such that the following examples should not be taken as limiting. Various modifications in the examples described herein will be readily apparent to those of ordinary skill in the art, and the general principles defined herein may be applied to other examples and applications without departing from the spirit and scope of the various examples. Thus, the various examples are not intended to be limited to the examples described herein and shown, but are to be accorded the scope consistent with the claims.

Various techniques and process flow steps will be described in detail with reference to examples as illustrated in the accompanying drawings. In the following description, numerous specific details are set forth in order to provide a thorough understanding of one or more aspects and/or features described or referenced herein. It will be apparent, however, to a person of ordinary skill in the art, that one or more aspects and/or features described or referenced herein may be practiced without some or all of these specific details. In other instances, well-known process steps and/or structures have not been described in detail in order to not obscure some of the aspects and/or features described or referenced herein.

In the following description of examples, reference is made to the accompanying drawings which form a part hereof, and in which it is shown by way of illustration specific examples that can be practiced. It is to be understood that other examples can be used, and structural changes can be made without departing from the scope of the disclosed examples.

The terminology used in the description of the various described examples herein is for the purpose of describing particular examples only and is not intended to be limiting. As used in the description of the various described examples and the appended claims, the singular forms "a," "an," and "the" are intended to include the plural forms as well, unless the context clearly indicates otherwise. It will also be understood that the term "and/or" as used herein refers to and encompasses any and all possible combination of one or more of the associated listed items. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

FIGS. 1-6 illustrate different views of an example flying ring, according to aspects of the disclosure. The flying ring comprises a flying ring body 100, an LED strip 200, an LED strip guard 300, an inner rim 600, a battery compartment 400, and a circuit compartment 500. The flying ring body 100 may comprise lightweight, impact-resistant materials such as polypropylene (PP), polyethylene (PE), high density polyethylene (HDPE), low density polyethylene (LDPE), linear low-density polyethylene (LLDPE), thermoplastic elastomer (TPE), foam, or a combination of these materials. In some examples, 80% of the flying ring body comprises PP, PE, HDPE, LDPE, LLDPE, TPE, or a combination thereof.

Figure 7:
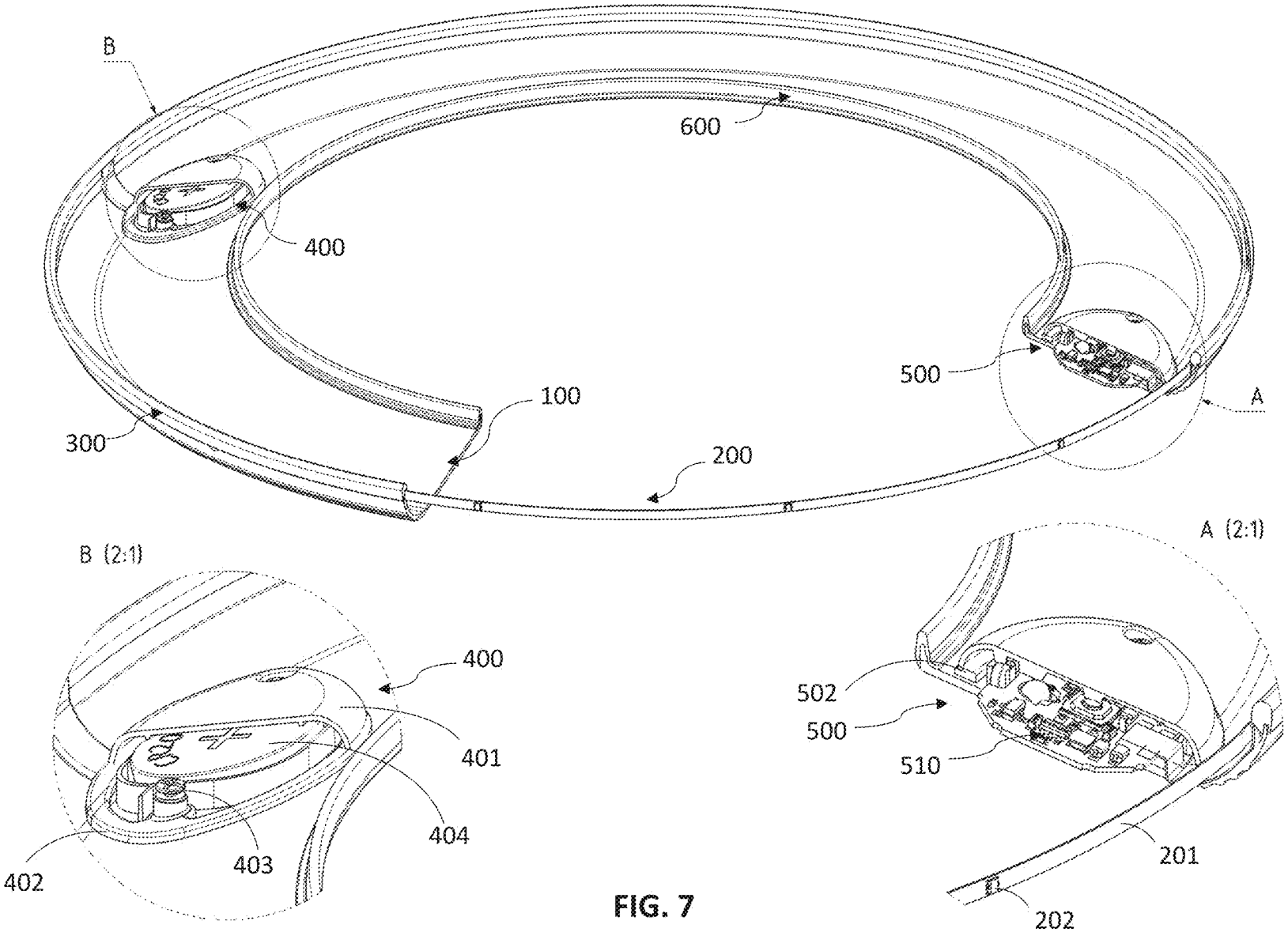
FIG. 7 illustrates a partially cropped, detailed perspective, bottom view of an example flying ring, and magnified views of example battery and circuit compartments, according to examples of the disclosure.

The LED strip 200 may be located along one or more sections of an outer rim of the flying ring. The LED strip 200 may be located such that one or more LED lights can emit light outward in a radial direction from the center of rotation (e.g., near the intersection of F7 and F8 shown in FIG. 2) of the flying ring. The LED strip 200 may comprise LED lights 202. The LED lights 202 may comprise blocks or clusters of LEDs, standalone LEDs, and/or LED microcircuits. The LED strip(s) may comprise any number of LED lights 202, from 3-3000 LED lights. In some examples, the LED strip 200 is formed by mounting LED lights 202 on a flexible circuit board 201, as shown in FIG. 7. The flexible circuit board 201 may be circular in shape. In some aspects, the flexible circuit board 201 may be located along the outer and/or inner rims of the flying ring. The flexible circuit board 201 may be made of a flexible material having conductive paths on the surface. The LED lights 202 may be mounted on the flexible circuit board 201 using Surface-Mount Technology (SMT) or Chip-On-Board (COB) technology.

Referring back to FIGS. 1-6, the protective ring 300 (also referred to as an LED strip guard) may cover the outside of the LED strip 200. In some examples, the LED strip guard 300 may be attached to the flying ring body 100. The LED strip guard 300 may comprise a material that allows visible light to pass through. For example, the LED strip guard 300 may allow light emitted from the LED strip 200 to be emitted outwards. The LED strip 200 and LED strip guard 300 may be configured to allow light to be emitted at least partially around the rim of the flying ring at one or more locations of the LED strip 200, outward in a radial direction from the center of rotation of the flying ring.

The LED strip guard 300 may comprise a lightweight, impact-resistant materials such as PP, PE, HDPE, LDPE, LLDPE, TPE, TPU, or a combination of these materials. In some examples, 80% of the LED strip guard 300 may be made of PP, PE, HDPE, LDPE, LLDPE, TPE, TPU, or a combination of these materials. In some embodiments, the LED strip guard 300, the inner rim, or both may comprise a soft, elastic material with a hardness of less than 60 Shore A to create a comfortable feeling when holding, throwing, and/or catching the flying ring. In some aspects, the LED strip guard 300 may comprise a luminescence material that allows the flying ring to be illuminated by the light emitted from the LED lights 202 when on, and also allows the flying right to glow in the dark (e.g., to make it easier to find) when the LED lights 202 are off. The LED strip guard 300 material may also allow the flying ring to be safe for use (e.g., when the flying ring is flying and/or makes contact with one or more players).

The inner rim 600 may comprise a soft material. In some aspects, the inner rim 600 may comprise the same material as the LED strip guard 300. The inner rim 600 may be configured with a material that increases the grip comfort and safety when the player's hand touches (e.g., grips) the inner rim 600 of the flying ring.

Figure 8:
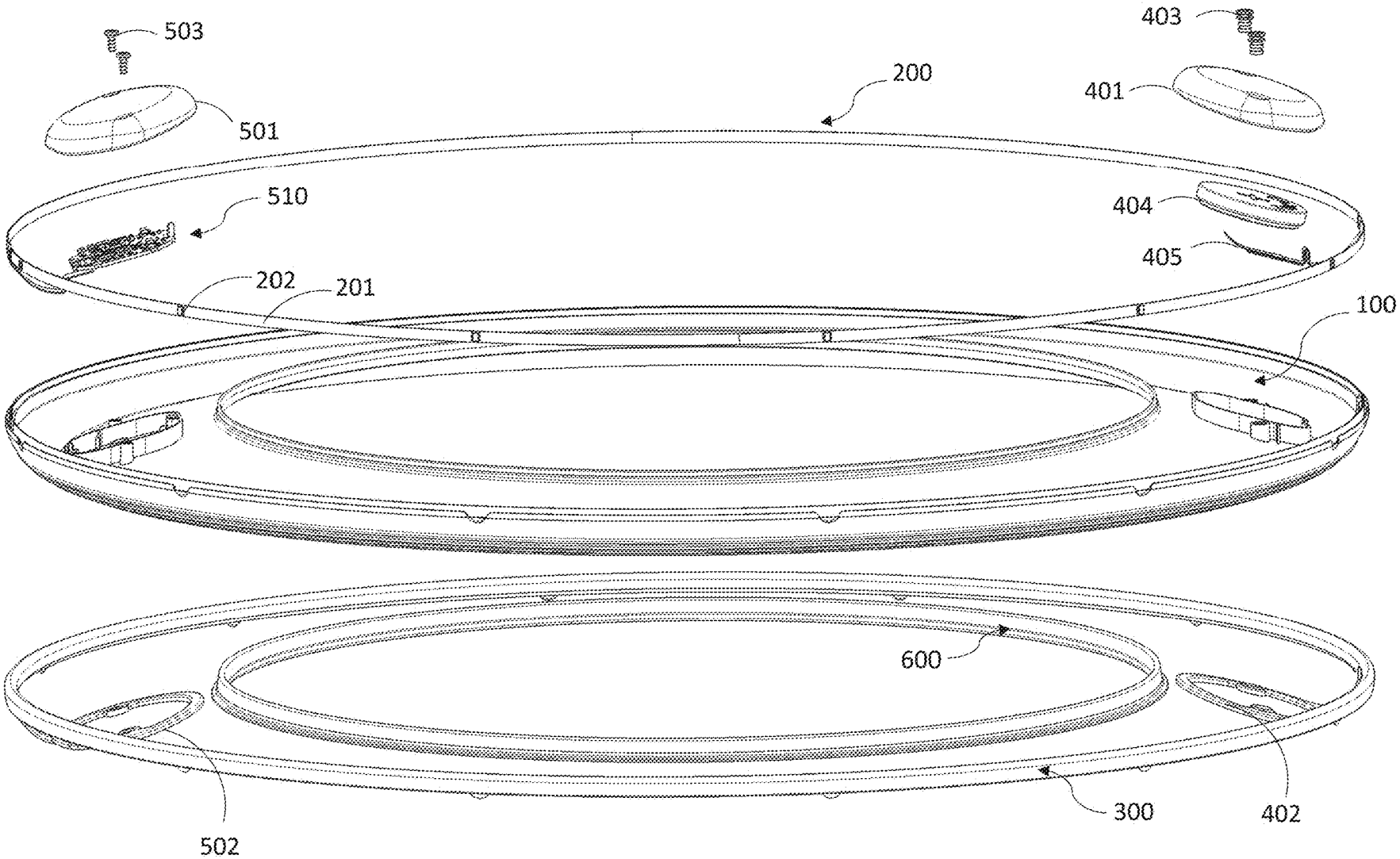
FIG. 8 illustrates a perspective, bottom view of an example components of a flying ring, according to examples of the disclosure.
Figure 9:
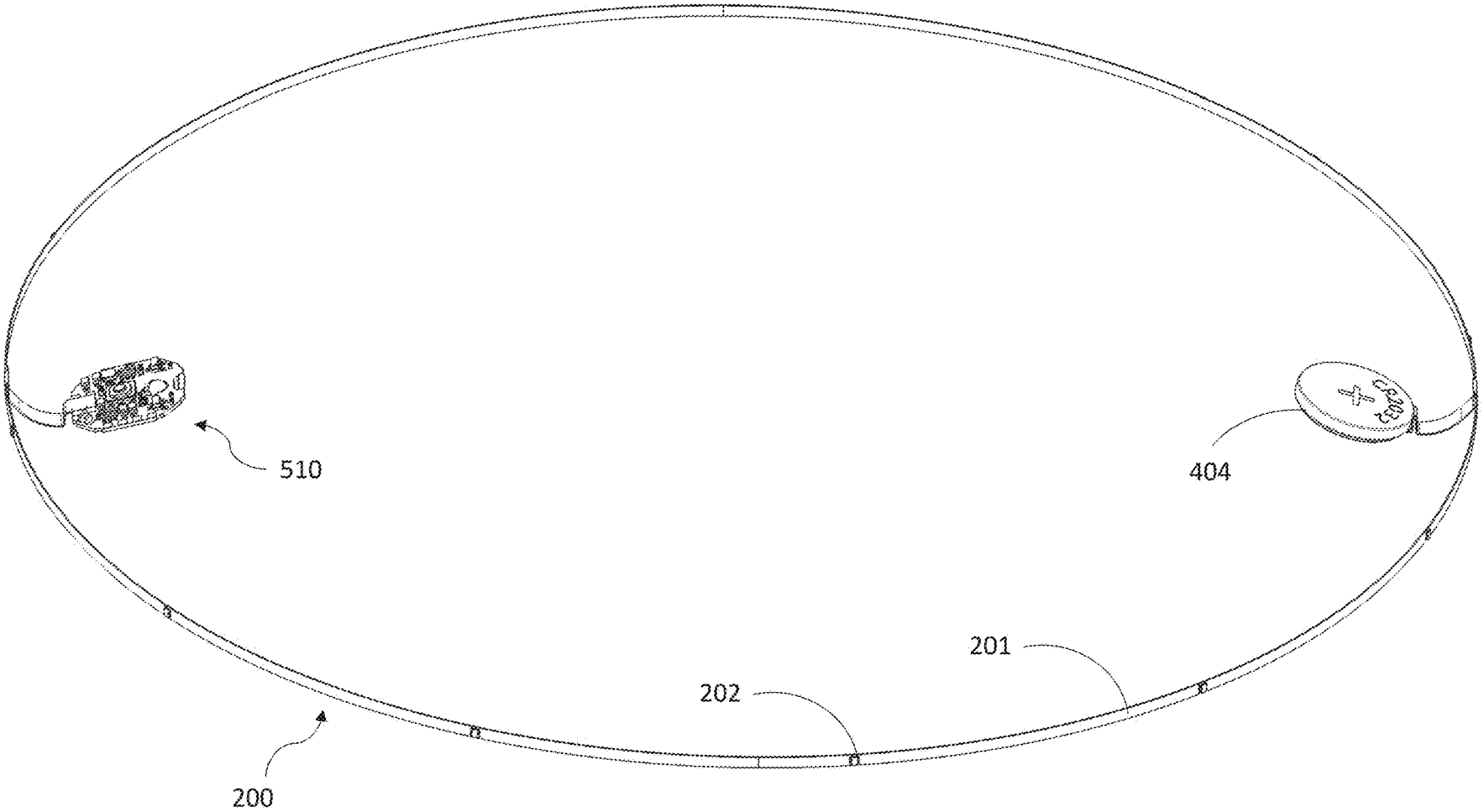
FIG. 9 illustrates a perspective view of a structure of an example LED circuit, according to examples of the disclosure.

FIG. 7 is a partially cropped perspective bottom view of an example flying ring, according to examples of the disclosure. The bottom left portion of FIG. 7 illustrates a magnified view of the battery compartment 400. The battery compartment 400 may comprise a battery 404 secured in the battery compartment 400 by battery cover 401 and one or more battery screws 403. The battery 404 may couple to one or more contacts 405 (shown in FIG. 8) to provide input power to a controller 510 (shown in FIGS. 8 and 9) through electrical wires on a flexible circuit board 201. The flying ring may comprise a waterproof gasket 402 configured to keep water from entering the battery compartment 400. The battery compartment 400 may also be waterproof.

The bottom right portion of FIG. 7 illustrates a magnified view of a circuit compartment 500. The circuit compartment 500 comprise a controller 510 and a centrifugal switch (e.g., centrifugal switch 520 shown in FIGS. 10-13). The controller 510 may comprise at least one input for receiving power from the battery compartment 400 and at least one output for electrically coupling to the LED strip 200 (e.g., via solder joint 512 shown in FIGS. 10 and 11). Controller 510 may be attached to the flying ring body 100 and covered by a circuit cover 501, as shown in the detailed perspective view of FIG. 8.

The circuit cover 501 can be attached the flying ring body 100 by ultrasonic welding, hot plate welding, glue, and/or screw. For example, one or more circuit screws 503 may be used to attach the circuit cover 501 and waterproof gasket 502 to the flight ring body 100, ensuring that the circuit compartment 500 is waterproof and keeps the controller 510 safe when the flight ring is impacted during operation (e.g., while playing). In some aspects, the circuit compartment 500 may also be waterproof.

The structure and location of the battery compartment 400, control circuit compartment 500, and other components of the flying ring may be configured such that the center of inertia coincides with the rotation axis of the flying ring, providing stable flight.

In some aspects, the flying ring comprises at least one centrifugal switch comprises an object whose mass, under the influence of a centrifugal force, moves and either directly touches a switch circuit contact or indirectly applies a force to a switch to change its circuit state. Examples of the disclosure may include different centrifugal switches.

Figure 10:
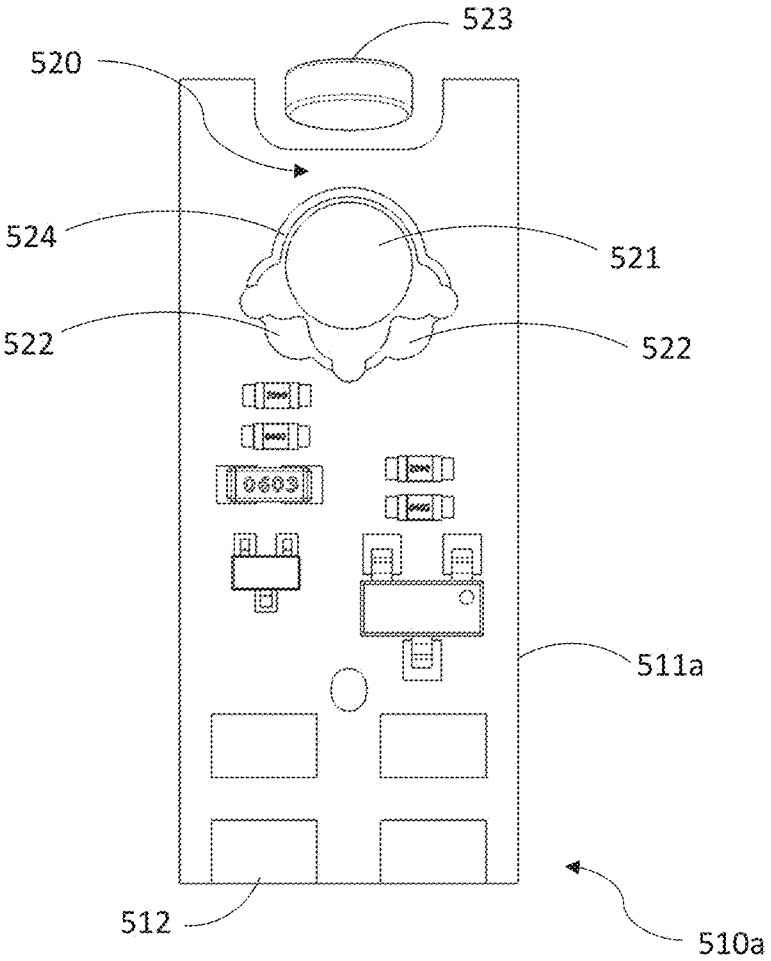
FIG. 10 illustrates a simplified drawing of an example central circuit board, according to examples of the disclosure.
Figure 11:
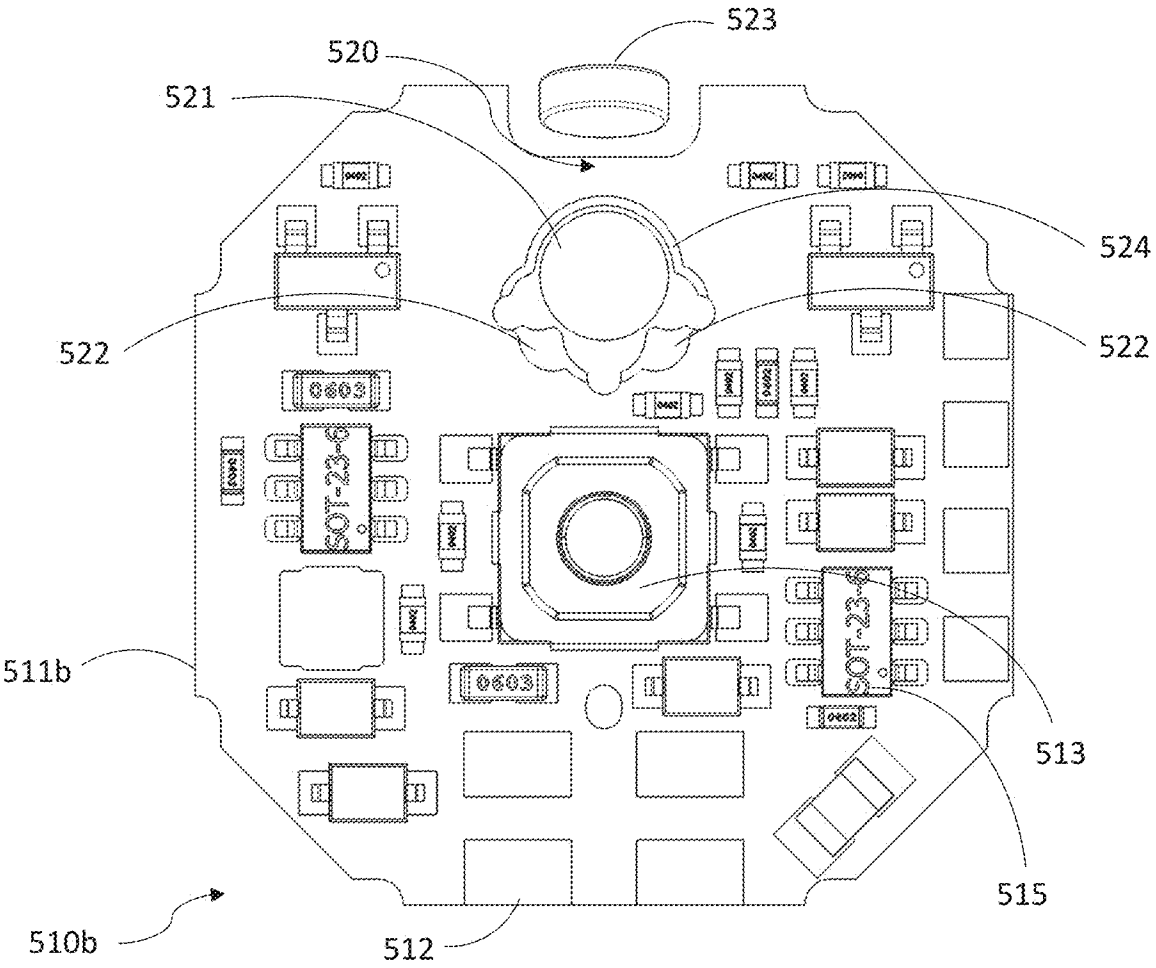
FIG. 11 illustrates a simplified drawing of an example central circuit board, according to examples of the disclosure.

FIGS. 10 and 11 illustrate simplified drawings of example central circuit boards, according to examples of the disclosure. As shown in the figures, a centrifugal switch 520 may be attached to a controller 510*a* or 510*b*. The centrifugal switch 520 includes two contacts 522, a metal ball 521 having a conductive surface, a magnet 523, and a switch hole 524. The switch hole 524 may be a hole formed by cutting a portion of a printed circuit board 511*a* or 511*b*. In some examples, the switch hole 524 may be formed such that there is a small gap around the metal ball 521 allowing the metal ball 521 to move when force is applied in the appropriate direction.

When the flying ring is not rotating/flying or rotating/flying at a slow speed, the magnet 523 may attract the metal ball 521 toward the magnet 523, keeping the metal ball 521 from contacting the pair of contacts 522, thereby keeping the centrifugal switch 520 in an open circuit state.

When the flying ring rotates/flies fast enough, it may create a centrifugal force on the metal ball 521 to move it away from the magnet 523. The metal ball 521 may make conductive contact with the pair of contacts 522, causing the centrifugal switch 520 to close the circuit (closed circuit state). The current passing through the pair of contacts 522 is closed by the metal ball 521, creating a signal for the controller to automatically power on the LED strip. The invention is not limited to the centrifugal switches shown and described in the context of FIGS. 10 and 11, but includes other example centrifugal switches.

According to some examples, the flying ring uses an acceleration sensor or gyroscope to detect (determine whether) the rotation/movement of the flying ring, which may then control the LED strip to turn on or off automatically by outputting a signal to the controller to turn on or off the LED lights in the LED strip. The controller may be configured to keep the LED light strip on for a pre-determined amount of time after the ring stops rotating or flying, making it easier for players to locate the ring in the dark.

Figure 12:
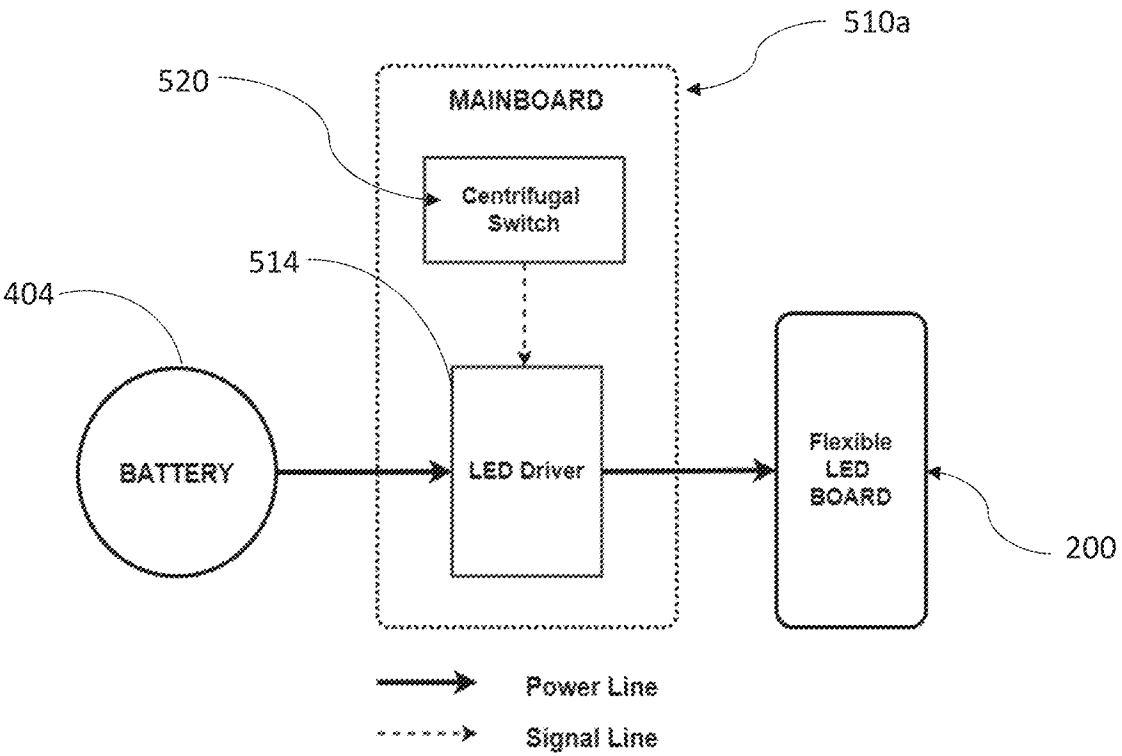
FIG. 12 illustrates a block diagram of an example controller of a flying ring, according to examples of the disclosure.
Figure 13:
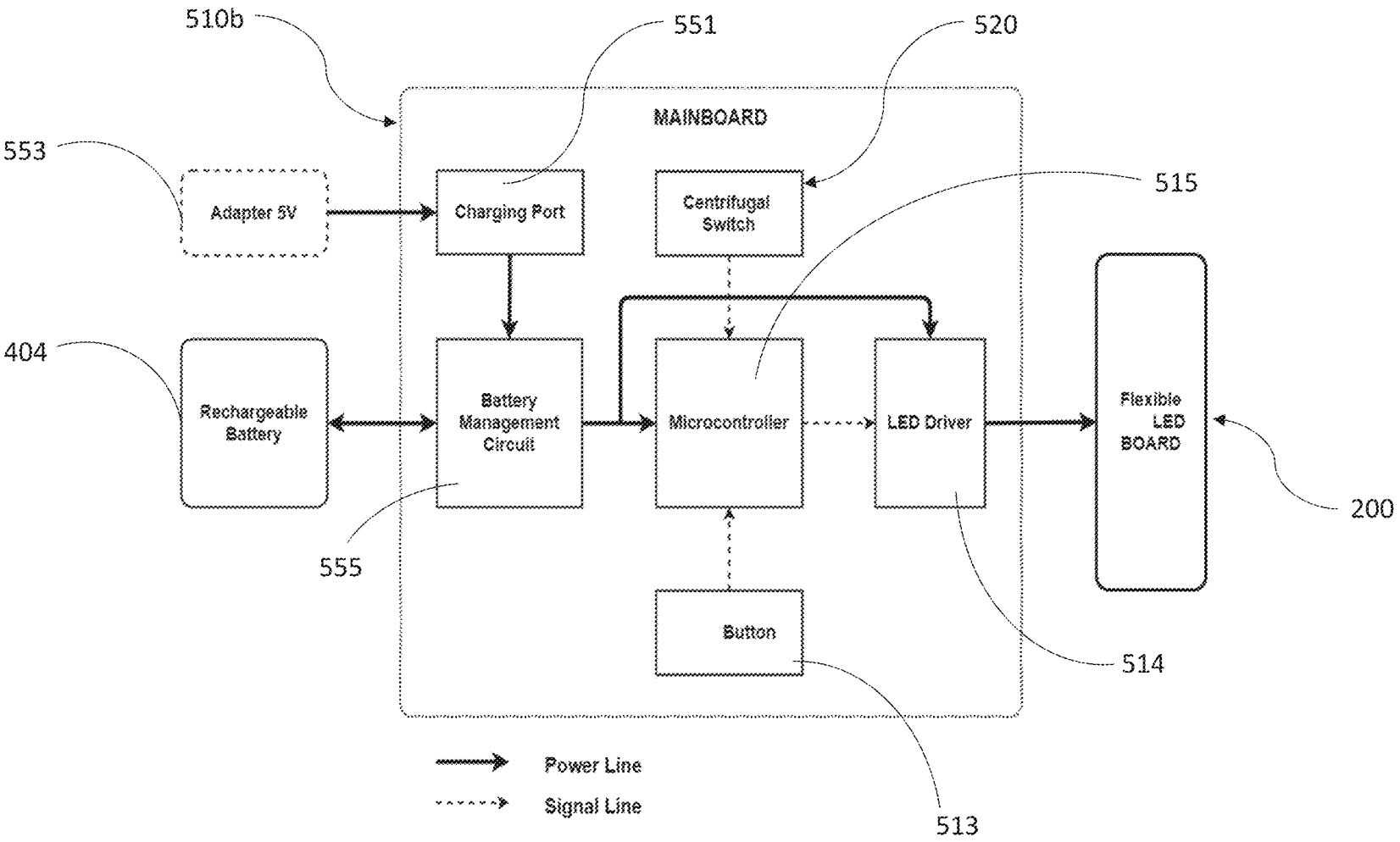
FIG. 13 illustrates a block diagram of an example controller of a flying ring, according to examples of the disclosure.

FIGS. 12 and 13 illustrates a block diagram of an example controller, according to aspects of the disclosure. In some examples, the LED strip control circuit system of FIG. 12 may be simpler than the one shown in FIG. 13. For ease of viewing, the figures show dashed arrows to represent the path(s) of a signal, such as a control or communication signal, and solid arrows to represent the path(s) of power source energy. The controller 510*a* shown in FIG. 12 may be similar to the controller 510*a* shown in FIG. 10. The controller 510*b* shown in FIG. 13 may be similar to the controller 510*b* shown in FIG. 11.

FIG. 12 illustrates a controller 510*a* comprising an input powered by a disposable battery 404, and an output coupled to an LED strip 200. The controller 510*a* may comprise an LED driver 514 configured to receive an input indicative of the state of a centrifugal switch 520 for powering or not power the LED strip 200.

With the controller 510*b* of FIG. 13, the battery may be a rechargeable battery 404 that can be charged through a charging port 551 mounted on the controller board. The charging port 551 may receive charge from an adapter 553, which may be used to provide power to a battery management circuit 555. The controller 510*b* may comprise an input powered by the battery 404, and an output coupled to an LED strip 200. The controller 510*b* may comprise a microcontroller 515 configured to receive signals from the centrifugal switch 520 and button 513. In some aspects, button 513 may be a pushbutton. Signals (e.g., indicative of an input from a user) from the button 513 may be used alone or in combination with a program stored in memory to provide control data for the LED driver 514. For example, the LED driver 514 may control one or more properties of the LED strip 200 including, but not limited to, automatically turning on when the flying ring rotates or flies, automatically turning off the light when the flying ring is not rotating or flying, changing the color of the LED lights, changing the brightness of the LED lights, randomly changing the LED color after each throw, or emitting light from the LED lights according to a pattern (e.g., a pre-defined pattern), creating a more attractive and enjoyable flying ring for players.

Although examples of this disclosure have been fully described with reference to the accompanying drawings, it is to be noted that various changes and modifications will become apparent to those skilled in the art. Such changes and modifications are to be understood as being included within the scope of examples of this disclosure as defined by the appended claims.

The invention claimed is:

1. A flying ring comprising:

a flying ring body comprising a circular outer rim and an inner rim that surrounds a hole in a middle of the flying ring body;

one or more LED strips arranged on the outer rim and configured to emit light outward in a radial direction from a center of rotation of the flying ring body, wherein each of the one of the one or more LED strips comprises:

a flexible circuit board comprising a plurality of electrical wires, the flexible circuit board arranged on and around the outer rim, and a plurality of LED lights attached to the flexible circuit board;

one or more compartments attached to the flying ring body, the one or more compartments comprising:

a first compartment between the inner rim and the outer rim, and comprising a battery, and a second compartment between the inner rim and the outer rim, and comprising a controller and a first centrifugal switch, wherein the first compartment and the second compartment are attached and configured such that a center of inertia coincides with the center of rotation, wherein:

a first electrical wire of the plurality of electrical wires couples the battery to the controller, and a second electrical wire of the plurality of electrical wires couples the controller to the plurality of LED lights; and one or more centrifugal switches coupled to the controller and configured to cause the controller to turn on the one or more LED strips, wherein the one or more centrifugal switches comprise the first centrifugal switch, wherein the controller comprises an input powered by the battery and an output coupled to the one or more LED strips, and is configured to keep the one or more LED strips on for a pre-determined amount of time after the flying ring stops rotating or flying.

2. The flying ring of claim 1, further comprising:

an LED strip guard covering the one or more LED strips, wherein the LED strip guard comprises a material for allowing visible light to pass through, such that the light emitted from the one or more LED strips propagates outward in the radial direction.

3. The flying ring of claim 2, wherein the material of the LED strip guard comprises a soft material with a hardness of less than 60 Shore A.

4. The flying ring of claim 2, wherein the material of the LED strip guard comprises a luminescence for allowing the flying ring to glow in the dark.

5. The flying ring of claim 2, wherein 80% of the material of the LED strip guard comprises PP, PE, HDPE, LDPE, LLDPE, TPE, or a combination thereof.

6. The flying ring of claim 1, wherein the inner rim comprises a soft material with a hardness of less than 60 Shore A.

7. The flying ring of claim 1, wherein 80% of the flying ring body comprises PP, PE, HDPE, LDPE, LLDPE, TPE, or a combination thereof.

8. The flying ring of claim 1, wherein the one or more centrifugal switches are configured to create a closed circuit when the flying ring rotates or flies, wherein the creating the closed circuit causes the one or more LED strips to turn on.

9. The flying ring of claim 1, wherein the one or more centrifugal switches are configured to create an open circuit when the flying ring does not rotate or fly, wherein the creating the open circuit causes the one or more LED strips to turn off.

10. The flying ring of claim 1, wherein the one or more centrifugal switches comprise a magnet and a metal ball configured to attract the magnet.

11. The flying ring of claim 1, further comprising:

one or more acceleration sensors configured to:

determine whether the flying ring is rotating or flying; and output a signal to the controller to turn on the one or more LED strips in accordance with a determination that the flying ring is rotating or flying.

12. The flying ring of claim 1, further comprising:

one or more gyroscope sensors configured to:

determine whether the flying ring is rotating or flying; and output a signal to the controller to turn on the one or more LED strips in accordance with a determination that the flying ring is rotating or flying.

13. The flying ring of claim 1, wherein the one or more compartments comprise a waterproof cover and a waterproof gasket.

14. The flying ring of claim 1, wherein the flying ring is configured to float on a water surface.

15. The flying ring of claim 1, wherein the one or more LED strips comprise 3 to 3000 LED lights.

16. The flying ring of claim 1, wherein the plurality of LED lights is configured to emit a plurality of colors.

17. The flying ring of claim 1, further comprising:

one or more of a button, a switch, and a knob configured to receive an input to change or select a color, a brightness, or a display mode of the plurality of LED lights of the one or more LED strips.

18. The flying ring of claim 1, wherein the one or more centrifugal switches comprise two or more centrifugal switches arranged symmetrically about the center of rotation of the flying ring body, wherein in accordance with the flying ring rotating or flying, the two or more centrifugal switches create a closed circuit that causes the one or more LED strips to turn on.

19. The flying ring of claim 1, further comprising a battery management circuit configured to provide power to the controller and the one or more LED strips.

20. The flying ring of claim 1, further comprising a memory, wherein the memory stores control data for causing the LED lights to:

emit in first colors; and in response to the flying ring being thrown, change the emission in the first colors to second colors, wherein the second colors are randomly determined.

* * * * *